United States Patent [19]

Brown et al.

[11] Patent Number: 4,795,996

[45] Date of Patent: Jan. 3, 1989

[54] ELECTRONIC SECTIONALIZER WITH RESETTABLE ACTUATOR

[75] Inventors: Robert A. Brown; Daren A. Clark, both of Centralia, Mo.

[73] Assignee: A.B. Chance Company, Centralia, Mo.

[21] Appl. No.: 128,688

[22] Filed: Dec. 4, 1987

[51] Int. Cl.[4] ..... H01H 71/10; H01H 71/20

[52] U.S. Cl. ..... 337/169; 337/171; 337/175; 335/32

[58] Field of Search ..... 337/168–179; 335/26–34

[56] References Cited

U.S. PATENT DOCUMENTS

| | | | |
|---|---|---|---|
| 2,951,924 | 9/1960 | Schultz | 337/169 |
| 3,239,617 | 3/1966 | Rigert | 335/32 |
| 3,321,721 | 5/1967 | Smith, Jr. | 335/32 |
| 3,801,946 | 4/1974 | Blewitt | 335/174 |
| 4,546,341 | 1/1985 | McNaghten et al. | 337/177 |
| 4,553,188 | 11/1985 | Aubrey et al. | 361/115 |
| 4,636,764 | 1/1987 | Mee et al. | 337/169 |

*Primary Examiner*—H. Broome

*Attorney, Agent, or Firm*—Hovey, Williams, Timmons & Collins

[57] ABSTRACT

An electronic sectionalizer for a branch line of a high voltage power distribution system has a resettable actuator for unlatching a trunnion member and release of a sectionalizer tube toward a disabled or drop-out orientation. The actuator includes an elongated, spring-loaded plunger normally held by a latch in loaded position, and a solenoid or the like is provided to shift the latch and enable movement of the plunger toward a released position for simultaneous swinging movement of the trunnion member. In certain forms of the invention, the plunger is directly engageable with a wall of the trunnion member, while in other embodiments of the invention mechanical advantage is provided by use of an elongated lever which is disposed in the path of the plunger and which bears against the trunnion member for initiating rotational movement of the latter.

12 Claims, 2 Drawing Sheets

ELECTRONIC SECTIONALIZER WITH RESETTABLE ACTUATOR

BACKGROUND OF THE INVENTION

1. Field of the Invention

The present invention broadly concerns apparatus for initiating drop-out motion of a latched electronic sectionalizer tube for isolating a branch or lateral line of a high voltage power distribution system. More specifically, the invention is directed toward a resettable sectionalizer actuator assembly having an electronic solenoid which, upon energization, releases a spring-loaded plunger. In turn, the unlatched plunger exerts, either directly or indirectly, a force on a trunnion member sufficient to release the member from its normally latched, stationary disposition and initiate pivotal movement of the member for drop-out of the sectionalizer tube toward an isolated position.

2. Description of the Prior Art devices known as automatic reclosers or reclosing circuit breakers are often used to protect the main supply line as well as lateral lines of a high voltage power distribution system. The recloser is operable to sense the magnitude of current flowing through the main supply line and disable the entire downstream distribution system if currents above a certain magnitude are detected. After a short period of current interruption, the recloser automatically re-energizes the circuit unless excess current conditions are again subsequently sensed.

In many instances, electronic sectionalizers are installed at the beginning of each lateral line of distribution systems having an automatic recloser or reclosing circuit breaker. Each sectionalizer cooperates with the recloser bu disabling the respective lateral line served by the sectionalizer during a subsequent dead portion of one of the opening and closing sysles of the recloser if current conditions in the lateral line are greater than a certain, pre-selected value. In this manner, current flow may be automatically restored to the remaining lateral lines duyring a subsequent closing cycle of the recloser.

Preferably, electronic sectionalizers for outdoor use are physically interchangeable with conventional electrical cut-outs so that the sectionalizer can be easily installed in retrofit fashion in the mounting structure originally provided to hold the cut-out. Normally, then, electronic sectionalizers include an alongated tube assembly having an upper conductive portion releasably engageable with an upper contact of the cut-out mounting structure, and a pivot mechanism received on a lower contact of the mounting structure. The elongated tube conducts current between the upper contact and the pivot mechanism in engagement with the lower contact of the mounting structure, and a sensing device mounted on the tube detects the magnitude of current. The tube also carries a logic circuit coupled to the sensor which typically fires a one-shot chamical actuator once the logic circuit has determined that over-current conditions exist in the lateral line protected by the sectionalizer after one or more cycles of operation of the reclosing apparatus.

In the past, chemical actuators of electronic sectionalizer assemblies were arranged to release or open a latch to initiate drop-out motion of the sectionalizer tube away from its normal upright orientation conducting current between the upper and lower mounting structures and toward an open-circuit orientation wherein the top of the tube is spaced from the upper mounting structure. As an example, U.S. Pat. No. 4,553,188, dated Nov. 12, 1985 illustrates a sectionalizer having a chemical actuator that, once fired, causes a latch or release lever to swing toward an out-of-the-way position and thereafter enable a spring and/or the forces of gravity to initiate pivotal movement of the sectionalizer tube and enable the tube to swing away from the upper contact. Another example of a chemical actuator and pivot mechanism for a sectionalizer is described in U.S. Pat. No. 4,636,764, dated Jan. 13, 1987 wherein the actuator is positioned to release a toggle mounting lever from an over-center position for subsequent drop-out of the sectionalizer tube away from the upper mounting structure.

In a co-pending application entitled "Latch and Pivot Mechanism for Electronic Sectionalizer Mounting Structure", filed Sept. 11, 1987, Ser. No. 07/095,548 and assigned to the assignee of the present invention, an electronic sectionalizer is provided with a chemical actuator that is positioned to strike, upon firing, a trunnion member for immediate drop-out of the sectionalizer tube with minimal reliance upon a spring or the effects of gravity. A latch is provided for normally holding the sectionalizer tube in a loaded, non-over-center position, and substantially the entire force of the chemical actuator is imparted directly upon the trunnion member to ensure reliable and rapid motion of the sectionalizer tube toward a disabled, open circuit orientation.

However, there is a long felt need for a resettable actuator assembly for an electronic sectionalizer so that the cost of replacing chemical actuators can be eliminated. Each chemical actuator must be replaced once fired, and thus utilities are faced not only with the cost of purchasing and maintaining a sufficient number of actuators on hand at all times but also with the expense of labor for installing the actuators and connecting leads to the actuator to the logic circuit.

In U.S. Pat. No. 3,321,721, dated May 23, 1967, a mechanical sectionalizer is described that includes an electric solenoid and plunger assembly which is arranged to release a latch for subsequent drop-out movement of the sectionalizer away from its mounting structure. The latch of U.S. Pat. No. 3,321,721 is in the form of a swingable lever which, when pivoted by the solenoid plunger, releases a second lever normally holding the sectionalizer in a current-carrying orientation; subsequently, the second lever swings about a pivot under the influence of gravity until the top portion of the sectionalizer assembly has fallen away from upper mounting structure and toward a current disabled or drop-out position. However, the dual swinging lever arrangement shown in U.S. Pat. No. 3,321,721 is somewhat unsatisfactory in that a certain amount of time is needed subsequent to release of the second lever for enabling the latter to gain momentum and swing in an arc a sufficient distance to allow the upper portion of the sectionalizer tube to drop away from the upper mounting structure.

Moreover, outdoor sectionalizers installed on cut-out mountings are exposed to rain, ice, and extreme swings of temperature. The pivot mechanism is normally held in a stationary position for extended periods of time and is therefore subject to the effects of corrosion, ice, or debris which may eventually prevent successful drop-out of the sectionalizer tube. Consequently, it would be advantageous to provide a latch and pivot mechanism for an electronic sectionalizer which would reliably disable the branch line as needed, and yet could be re-set for subsequent use without the trouble and expense of installing a one-shot chemical actuator.

SUMMARY OF THE INVENTION

Our present invention overcomes the problems noted hereinabove by provision of an electronic sectionalizer having a resettable actuator which comprises a solenoid as well as a latch and pivot mechanism arranged to provide immediate, reliable drop-out movement of the sectionalizer tube upon energization of the solenoid. The actuator assembly includes a spring-loaded plunger movable in a longitudinal direction when unlatched and oriented to direct substantially all of its momentum toward a trunnion for initiating pivotal movement of the latter and simultaneous drop-out of the sectionalizer tube away from the upper contact mounting structure.

A variety of forms of the invention are possible and disclosed herein. In particular, certain embodiments of the invention are directed toward a releasable plunger movable to directly strike the trunnion member. In another embodiment, the plunger shifts to contact a lever which, provides mechanical advantage for initiating movement of the trunnion member. In yet another embodiment, the plunger moves towards a leg which is secured to the trunnion member and functions as a lever arm for facilitating swinging movement of the member.

Advantageously, the pivotal connection between the trunnion and the sectionalizer tube is located in non-overcenter relation to the upper and lower mounting structures, or more particularly to a reference line extending from the center of the upper end of the sectionalizer tube in engagement with the upper mounting structure and the center of outwardly extending pins of the trunnion member which are received in respective hook-shaped portions of the lower mounting structure. As a consequence, all of the force imposed on the trunnion member by the spring biased plunger immediately initiates movement of the sectionalizer tube in a downward direction to ensure successful drop-out of the tube away from the upper contact mounting structure within a relatively short period of time after energization of the solenoid.

DETAILED DESCRIPTION OF THE DRAWINGS

Figure 1:
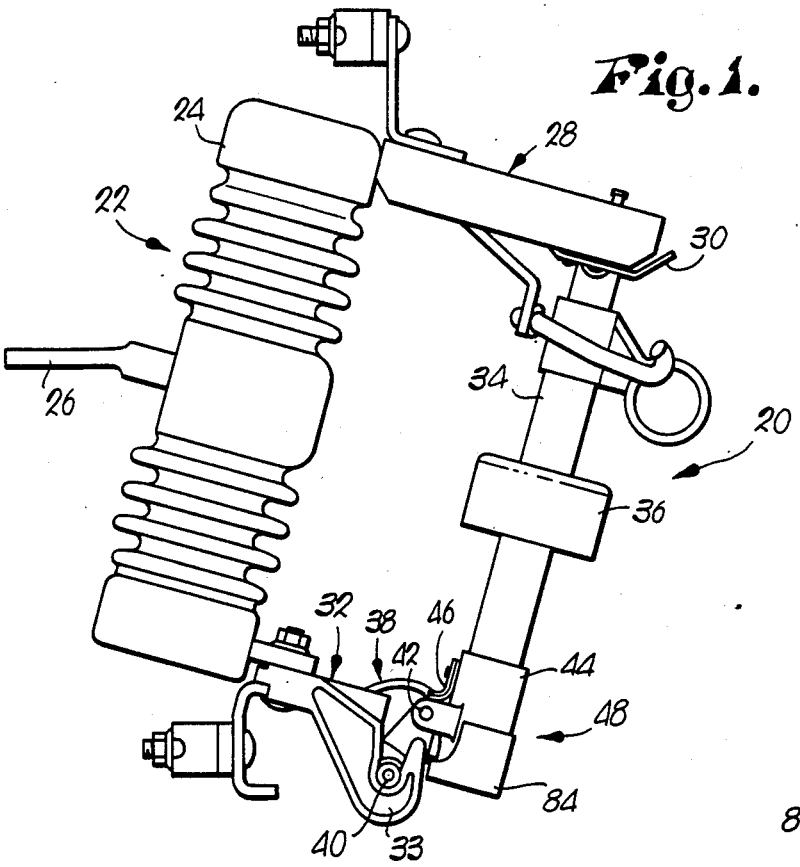
FIG. 1 is a side elevational view of an electronic sectionalizer of the present invention mounted, in a current-carrying orientation, in upper and lower contacts or mounting structures.

Turning first to FIG. 1, a sectionalizer 20 is carried by a mounting assembly 22 that includes an insulator 24 having an arm 26 for securing the assembly 22 to a utility pole or the like. The mounting assembly 22 has an upper electrical contact 28 that includes a conductive arm 30 having a concave detent. The arm 30 is biased downwardly by a compression spring as explained in greater detail in U.S. Pat. No. 4,546,341, dated Oct. 8, 1985, the disclosure of which is hereby expressly incorporated into the present disclosure.

The mounting assembly 22 also includes a lower contact 32 spaced from the upper contact 28 and mounted on an opposite end region of the insulator 24. The lower contact 32 includes a pair of spaced, hook-shaped portions 33 (only one shown) that are similar to the hook-shaped portions of the lower electrical contact illustrated and described in the aforementioned U.S. Pat. No. 4,546,341.

The sectionalizer 20 has an elongated, conductive element or tube 34 with an upper terminus that is received in the concave detent of arm 30 of the upper contact 28. An encased logic circuit 36, externally carried by tube 34, includes a means for sensing the magnitude of current flowing through tube 34 and for generating an output signal if the current conditions are above a certain, pre-selected value.

A trunnion member 38, disposed substantially between the hook-shaped portions 33 of the lower contact 32, has a pair of cylindrical pins 40 that extend horizontally outwardly in opposite directions and which are received in respective hook portions 33. The trunnion member 38 is pivotally connected by means of a pin 42 to a lower tube casting 44 of the sectionalizer tube 34. The longitudinal axis of pin 42 is parallel to the central axis of pins 40 for enabling swinging motion of the trunnion member 38 relative to the sectionalizer tube 34 during simultaneous swinging movement of the trunnion member 38 relative to the hook portions 33 of the lower contact 32. A spring contact 46 secured to the lower tube casting 44 normally engages a raised portion of the trunnion member 38 when the sectionalizer tube 34 is in its current-carrying or loaded position as shown in FIG. 1 for facilitating the flow of current from the upper contact 28, along the length of the conductive tube 34 and thereby across the trunnion member 38 to the lower contact 32.

Figure 2:
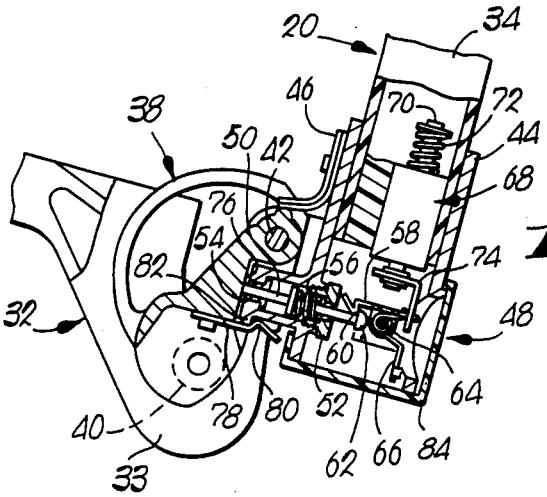
FIG. 2 is a fragmentary, enlarged, side cross-sectional view illustrating the resettable actuator assembly of the sectionalizer which is shown in FIG. 1.
Figure 4:
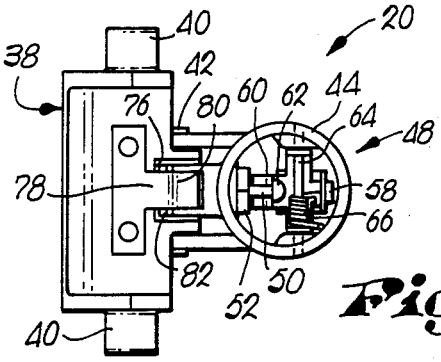
FIG. 4 is a bottom plan view of the sectionalizer tube and actuator assembly alone as shown in FIG. 3 with a cap normally covering a bottom end of the tube removed for clarity.
Figure 3:
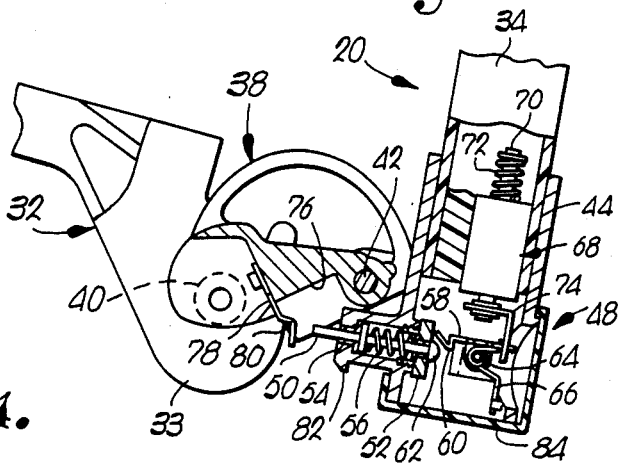
FIG. 3 is a view somewhat similar to FIG. 2 except that a solenoid coil of the actuator has been energized to release a plunger and initiate swinging member of the trunnion member simultaneous with downward shifting motion of the sectionalizer tube.

Turning now to the embodiment shown in more detail in FIGS. 2–5, a resettable actuator assembly 48 includes an elongated plunger 50 mounted within a recess of the lower tube casting 44 by means of a threaded, apertured cap 52. A forward end of the plunger extends through a teflon bushing 54, and the plunger 50 is yieldably biased in a direction toward its forward end by means of a compression spring 56 disposed between cap 52 and a circular flange of the plunger 50. The plunger 50 is movable in a longitudinal direction between a loaded position as shown in FIG. 2 and a released position as is depicted in FIG. 3.

The actuator assembly 48 further comprises a latch means in the form of a pivotal lever 58 that normally retains the plunger 50 in its loaded position. The lever 58 has a shoulder portion 60 that is releasably engageable with an enlarged head 62 of the plunger 50 remote from the forward end of the same. The lever 58 is pivotal about a pin 64 fixed to the lower tube casting 44, and the shoulder portion 60 of the lever 58 is biased toward a position of latched contact with the plunger head 62 by means of a torsion spring 66.

An electric impact solenoid 68, mounted within the sectionalizer tube 34, includes a coil and a central armature 70 which shifts in a downwardly direction upon energization of the coil. The armature 70 is yieldably biased in an upwardly direction by means of a compression spring 72. In addition, a lower portion of the armature 70 is coupled by means of an L-shaped link 74 to an end region of the pivotal latching lever 58 remote from the shoulder portion 60.

The solenoid 68 is electrically connected to the logic circuit 36. Once the logic circuit 36 has determined that an over-circuit condition exists in the lateral or branch line protected by the sectionalizer 20, the logic circuit 36 energizes the coil of the solenoid 68 and causes movement of the armature 70 in a downwardly direction. As a consequence, the pivotal lever 58 releases its shoulder portion 60 from the enlarged head 62 to thereby enable the plunger 50 to move under the influence of spring 56 in an outwardly direction and exert a force against a flat wall 76 of the trunnion member 38.

As the plunger 50 moves from its loaded position shown in FIG. 2 and towards its released or unlatched position as shown in FIG. 3, the force of the plunger 50 exerted on the flat wall 76 urges the trunnion member 38 in a direction of clockwise rotation (viewing FIGS. 2 and 3) relative to the hook portions 33 of the lower contact 32 and relative to the sectionalizer tube 34. As the spring-loaded plunger 50 moves outwardly toward its released position shown in FIG. 3, the energy exerted by spring 56 is sufficient for overcoming a latch 78 that normally retains the trunnion member 38 in its position shown in FIGS. 1 and 2. One end of the spring latch 78 is secured to the trunnion member 38, while the opposite end presents a raised shoulder or ridge 80 that is releasably engageable with a downwardly extending flange 82 formed as part of the lower tube casting 44. Thus, as the plunger 50 moves toward its released position shown in FIG. 3, the spring latch 78 deflects downwardly to clear the flange 82 and permit release of the trunnion member 38 from its latched or loaded orientation shown in FIGS. 1 and 2.

Advantageously, the pivotal connection or pin 42 coupling the trunnion member 38 to the sectionalizer tube 34 is positioned to one side of a reference line extending through the center of pins 40 held by the lower contact 32 and the center of the upper end of the sectionalizer tube retained in the detent formed in the upper contact arm 30. Therefore, the pin 42 is retained in a non-over-center relation to the aforementioned reference line when the sectionalizer tube 34 is held in its loaded, current-carrying orientation, so that the tube 34 immediately begins downward movement toward a drop-out orientation simultaneously with release of the spring-loaded plunger 50. As a consequence, downward movement of the sectionalizer tube 34 is effected essentially simultaneously with energization of the solenoid 68, and the downward movement is further facilitated by the forces of gravity as well as by the bias exerted by the compression spring urging the upper contact arm 30 in a downwardly direction. Once the trunnion member 38 has pivoted to approximately the position shown in FIG. 3, the upper end of the sectionalizer tube 34 disengages the upper contact arm 30 and falls away from the same toward a drop-out orientation in order to disable the lateral line protected by the sectionalizer 20.

The non-overcenter relationship of the pivot pin 42 as explained above is particularly advantageous in that the sectionalizer tube 34 immediately begins movement in a downwardly direction upon release of the spring-loaded plunger 50. This aspect of the sectionalizer 20 may be further understood by reference to the aforementioned pending application entitled "Latch and Pivot Mechanism for Electronic Sectionalizer Mounting Structure", Ser. No. 07/095,548, Filed Sept. 11, 1987.

Figure 5:
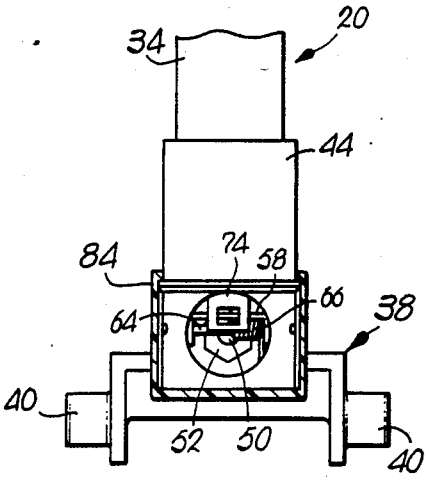
FIG. 5 is fragmentary, side elevational view with the cap broken away in section illustrating the sectionalizer tube and actuator assembly shown in FIG. 3.

As illustrated in FIGS. 2–3 and 5, a protective cap 84 is installed in snap-fit fashion over the lower end region of the tube casting 44. The cap 84 covers a lower access hole at the bottom of the tube casting 44, as well as a side access hole which is perhaps shown in FIG. 5. To reset the actuator assembly 48, however, one needs merely to push the plunger 50 a sufficient distance to allow the shoulder portion 60 of lever 58 to engage the enlarged head 62 of the plunger 50, and thereafter the spring 66 in cooperation with the shoulder portion 60 retains the plunger 50 in its latched or loaded orientation; then, the trunnion member 38 is pivoted about pin 42 until the ridge 80 of the spring latch 78 shifts around and behind the flange 82 of the lower tube casting 44.

Figure 6:
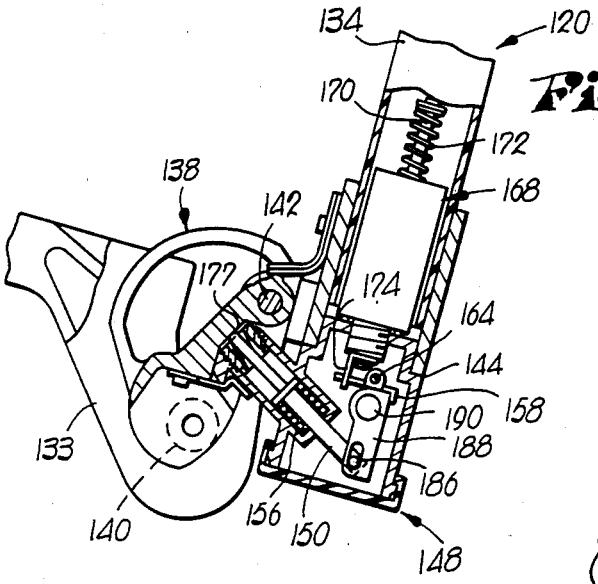
FIG. 6 is a fragmentary, side elevational view with parts broken away in section of a resettable actuator assembly in accordance with another embodiment of the invention.

In the embodiment shown in FIG. 6, a sectionalizer 120 has an elongated, hollow sectionalizer tube 134 and a trunnion member 138 which is pivotally connected to the tube 134 and lower contact hook portions 133 by pins 142, 140 respectively in a manner similar to like numbered components illustrated in the embodiment of FIGS. 2–5. However, in the form of the invention shown in FIG. 6, a plunger 150 biased in an outwardly, longitudinal direction by means of a spring 156 is inclined at an angle relative to the longitudinal axis of the sectionalizer tube 134. In addition, an inner end region of the plunger 150 is connected by a pin 186 to a bracket arm 188 that is pivotally coupled to a lower tube casting 144 by means of a pin 190. In turn, the bracket arm 188 is releasably held in a latched position by an L-shaped end region of a latching lever 158 that is pivotally mounted on a pin 164.

An end region of the lever 158 remote from the L-shaped latching end of the same is coupled by means of an L-shaped link 174 to a lower end of an armature 170. The armature 170 comprises part of an electric solenoid 168 that is threadably mounted in a complemental hole formed in a wall of the lower tube casting 144. The solenoid armature 170 is biased upwardly by means of a spring 172.

Thus, in the embodiment shown in FIG. 6, energization of the coil of the solenoid 168 urges the solenoid armature 170 in a downwardly direction to swing the lever 158 about pin 164. Consequently, the lever 158 releases the bracket arm 188 and the plunger 150 pivotally connected thereto for enabling the compression spring 156 to urge the plunger 150 in a longitudinal, outwardly oriented direction and toward a flat wall 177 formed as part of the trunnion member 138.

By comparison of FIGS. 2–5 with FIG. 6, it can be appreciated that the flat wall 177 and the associated, inclined plunger 150 are arranged in a somewhat different orientation than the plunger 50 and the flat wall 76 depicted in FIGS. 2–5. The form of the invention shown in FIG. 6 is advantageous because the direction of the force exerted by the spring loaded plunger 150 is somewhat closer to a true perpendicular orientation to a reference line drawn through pins 140, 142, that occurs, for example, in corresponding elements of the embodiment shown in FIGS. 2–5. As a consequence, somewhat greater torsional forces are established and less force is needed by spring 156 to unlatch the trunnion member 138 and shift the tube 134 toward its loaded, drop-out orientation.

Figure 7:
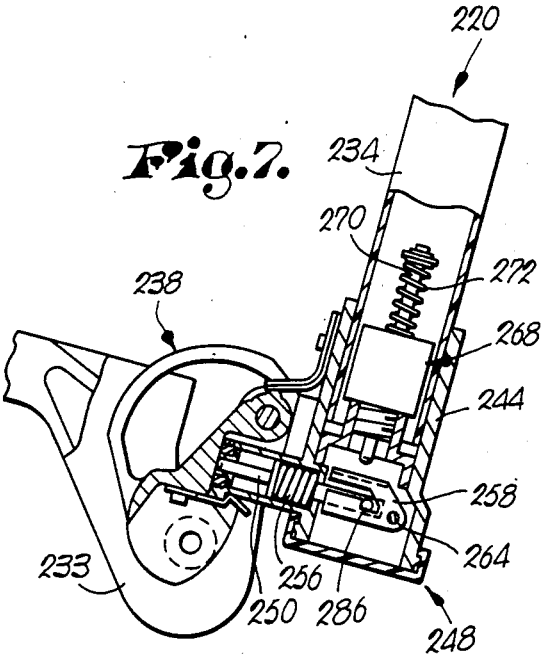
FIG. 7 is a fragmentary, side elevational view with parts broken away in section of a resettable actuator assembly according to another form of the invention.

Turning now to FIG. 7, a resettable actuator assembly 248 for a sectionalizer 220 includes an elongated plunger 250 biased outwardly by means of a spring 256 in a manner similar to like-numbered components shown in FIGS. 2–5. In the embodiment shown in FIG. 7, however, an inner end of the plunger 250 has a pair of outwardly extending pins 286 that are received in an L-shaped slot of a latch 258 that is pivotally mounted to a lower tube casting 244 by means of a pin 264. An impact solenoid 268 has a longitudinally shiftable armature 270 normally spaced above the latch 258 and biased upwardly by means of a spring 272.

Upon energization of the solenoid 268 by a logic circuit of the sectionalizer 220, the armature 270 immediately moves in a downwardly direction for contact with the latch 258. At this time, latch 258 swings about pin 264 to enable the plunger pins 286 to be brought into the major extent of the L-shaped slot of the latch 258, whereupon the spring 256 initiates movement of the plunger 250 in an outwardly direction to rotate the trunnion member 238 and cause the tube 234 to shift toward a current disabling, drop-out orientation.

Figure 8:
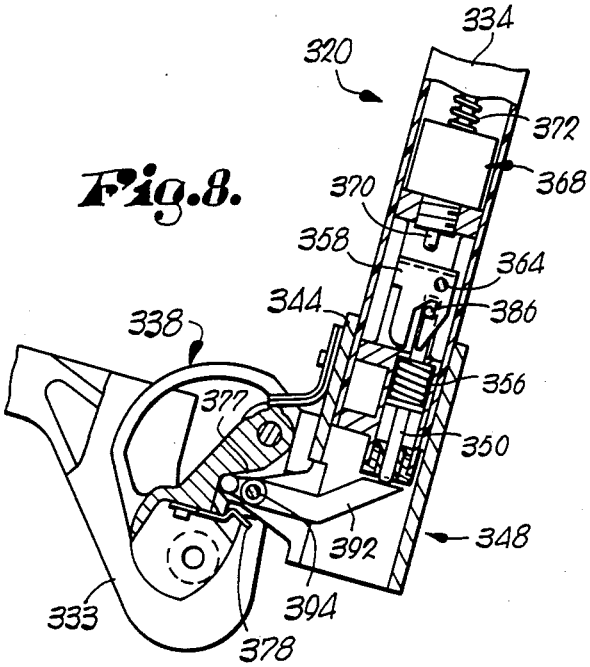
FIG. 8 is a fragmentary, side elevational view with parts broken away in section of another form of the resettable actuator assembly in accordance with the invention.

Referring now to the embodiment of the invention shown in FIG. 8, a resettable actuator assembly 348 is mounted within a lower region of a sectionalizer tube 334 and a tube casting 344 and includes an impact solenoid 368 having an armature 370 and normally biased in an upwardly direction by means of a spring 372. Upon energization of the solenoid 368, the armature 370 shifts downwardly and comes into contact with a latch 358 that is pivotally connected to the tube 334 by means of a pin 364. The latch 358 pivots in a counter-clockwise direction upon contact by the armature 370 during energization of solenoid 368.

Movement of the latch 358 in a counterclockwise direction (viewing FIG. 8) releases pins 386 of an elongated plunger 350 from a short, transversely extending portion of a slot formed in the lever 358. Upon release of pins 386, the plunger 350 immediately moves in a downwardly-oriented direction under the influence of a spring 356. The lower end of the plunger 350 is in contact with one end of an elongated lever 392 that is coupled to the lower tube casting 344 by means of a pivot 394.

An outer end of the lever 392 remote from the plunger 350 has a cylindrical shape, and is in engagement with an inclined, flat wall portion 377 of the trunnion member 338. Downward movement of the plunger 350 by the influence of spring 356 swings the lever 392 about pivot 394 and causes the outer cylindrical end of the lever 392 to exert a force on the trunnion member 338 and initiate clockwise rotation of the same (viewing FIG. 8).

Advantageously, the portion of the lever 392 between the pivot 394 and the plunger 350 is substantially longer than the portion on the lever 392 between pivot 394 and its outer cylindrical portion. As a result, the lever 392 provides a mechanical advantage to facilitate movement of the trunnion member 338 and overcome the resistance presented by spring latch 378 normally retaining the trunnion 338 in its loaded or operating orientation.

Figure 9:
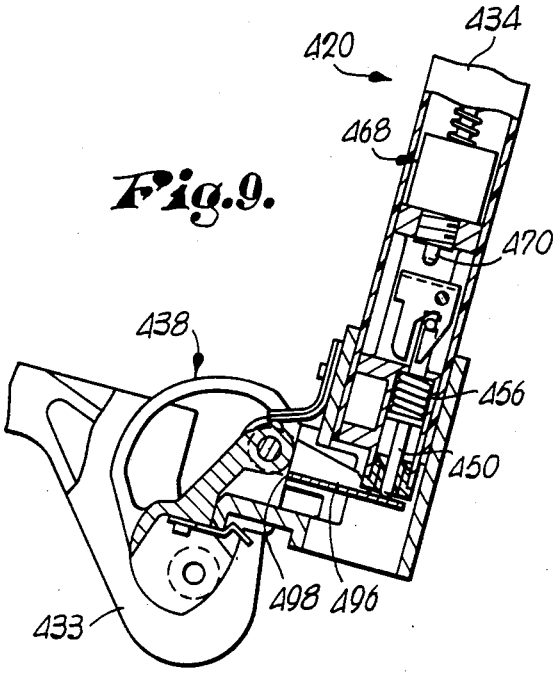
FIG. 9 is a fragmentary, side elevational view with parts broken away in section of yet another embodiment of the invention showing a somewhat different resettable actuator assembly for an electronic sectionalizer.

In embodiment illustrated in FIG. 9, solenoid 468, armature 470, latch 458 and spring-loaded plunger 450 are substantially identical to like-numbered components illustrated in FIG. 8. In FIG. 9, however, the lower end of the plunger 450 is in contact with a leg 496 that is connected to and bears against the trunnion member 438 along an edge 498. As an alternative, the leg 496 may be formed as an integral part of the trunnion member 438. Consequently, the leg 496 functions as a lever arm to facilitate the initiation of rotational movement of trunnion member 438 and cause the sectionalizer tube 434 to move toward a drop-out or isolated orientation.

It can now be appreciated that the resettable actuator assembly described herein in accordance with various embodiments of the invention advantageously enables the sectionalizer to be readily reset toward a latched position and put into service with relative ease. In this regard, the spring loaded plunger and associated latching mechanism is especially desirable because the forces generated by smaller solenoids are not normally sufficient for ensuring reliable unlatching of the trunnion and drop-out movement of the sectionalizer tube. However, the solenoid may possibly be replaced by another type of release or latch mechanism such as a magnetic release device or a piezo electric release device.

We claim:

1. A sectionalizer for use with upper and lower mounting structure comprising:

an elongated sectionalizer element having an upper end region for releasable contact with upper mounting structure;

a member for pivotal engagement with lower mounting structure;

means pivotally coupling said member to said element for swinging movement of said member relative to said element;

first latch means releasably retaining said member in stationary disposition relative to said element;

means for sensing current conditions through said element; and a resettable actuator assembly including an elongated plunger movable in a substantially longitudinal direction between a loaded position and a released position, means biasing said plunger toward said released position, second latch means normally retaining said plunger in said loaded position, and means coupled to said sensing means for releasing said second latch means and for thereby releasing said plunger from said loaded position, said plunger during movement toward said released position being operable to exert a force on said member of sufficient strength to overcome said first latch means and release said member for swinging movement relative to said element.

2. The invention as set forth in claim 1; and including structure connected to said sectionalizer element for mounting said plunger in disposition for direct contact with said member during movement of said plunger toward said released position.

3. The invention as set forth in claim 2, wherein said plunger contacts said member in a location between said pivotal coupling means and the location wherein said member pivotally engages said lower mount.

4. The invention as set forth in claim 1, wherein said plunger has an enlarged head and said second latch means comprises a pivotal lever presenting a shoulder portion releasably engageable with said head.

5. The invention as set forth in claim 4, wherein said latch means includes a spring yieldably biasing said shoulder portion of said lever towards an enlarged head of said plunger.

6. The invention as set forth in claim 1, wherein said latch means includes a swingable arm pivotally connected to said plunger, and wherein said latch means further includes a latching lever releasably engageable with said arm.

7. The invention as set forth in claim 1, wherein said plunger includes a pin extending in a direction transverse to the longitudinal axis of said plunger, and wherein said latch means includes a bracket pivotally mounted on said tube and having an L-shaped slot receiving said plunger.

8. The invention as set forth in claim 1; and including a lever pivotally connected to said sectionalizer tube, and wherein said plunger during movement toward its released position is engageable with said lever and said lever is engageable with said member for release of said member and for swinging movement of the latter relative to said lower mount and to said element.

9. The invention as set forth in claim 8, wherein said lever is elongated and is pivotally coupled to said tube at a location along the length of said lever presenting a longer region and a shorter region on opposite sides of said location pivotally coupling said lever to said tube, and wherein said longer region extends toward said plunger for increasing the mechanical advantage of the latter.

10. The invention as set forth in claim 1; and including leg means connected to said member and extending toward a position in the path of said plunger as the latter moves toward its released position.

11. The invention as set forth in claim 1, wherein said means coupled to said sensing means for releasing said second latch means comprises an electric solenoid having coil means and an armature movable upon energization of said coil means.

12. The invention as set forth in claim 11, wherein said electric solenoid includes means yieldably biasing said armature in a direction generally opposite to the direction of movement of said armature upon energization of said coil means.

* * * * *